US010935898B2

(12) United States Patent
Kuroiwa et al.

(10) Patent No.: US 10,935,898 B2
(45) Date of Patent: Mar. 2, 2021

(54) ELECTROPHOTOGRAPHIC PHOTOSENSITIVE MEMBER, PROCESS CARTRIDGE, AND ELECTROPHOTOGRAPHIC APPARATUS

(71) Applicant: CANON KABUSHIKI KAISHA, Tokyo (JP)

(72) Inventors: Ikuyo Kuroiwa, Tokyo (JP); Kumiko Takizawa, Saitama (JP); Tsuyoshi Shimada, Kashiwa (JP); Kan Tanabe, Matsudo (JP); Haruhiko Mitsuda, Nagareyama (JP); Takanori Ueno, Nagareyama (JP); Tatsuya Ikezue, Toride (JP); Wataru Kitamura, Abiko (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 16/655,494

(22) Filed: Oct. 17, 2019

(65) Prior Publication Data

US 2020/0124996 A1 Apr. 23, 2020

(30) Foreign Application Priority Data

Oct. 17, 2018 (JP) ..... JP2018-195912

(51) Int. Cl.
*G03G 5/05* (2006.01)
*G03G 5/14* (2006.01)
*G03G 5/147* (2006.01)

(52) U.S. Cl.
CPC ..... *G03G 5/0575* (2013.01); *G03G 5/144* (2013.01); *G03G 5/14769* (2013.01)

(58) Field of Classification Search
CPC ... G03G 5/144; G03G 5/14769; G03G 5/0575
See application file for complete search history.

(56) References Cited

U.S. PATENT DOCUMENTS

| | | | | |
|---|---|---|---|---|
| 8,883,384 | B2 * | 11/2014 | Dinh | G03G 5/14786 430/58.8 |
| 2009/0208250 | A1 * | 8/2009 | Mitsumori | G03G 5/144 399/159 |
| 2009/0238602 | A1 * | 9/2009 | Iwasaki | G03G 5/14769 399/111 |
| 2018/0314173 | A1 * | 11/2018 | Shimada | G03G 5/144 |

FOREIGN PATENT DOCUMENTS

| | | | |
|---|---|---|---|
| JP | 2006011485 | A | 1/2006 |
| JP | 2006084711 | A | 3/2006 |
| JP | 2009031721 | A | 2/2009 |
| JP | 2012203253 | A | 10/2012 |
| JP | 2013178367 | A | 9/2013 |
| JP | 2018141972 | A | 9/2018 |

* cited by examiner

*Primary Examiner* — Christopher D Rodee
(74) *Attorney, Agent, or Firm* — Canon U.S.A., Inc. IP Division

(57) ABSTRACT

An electrophotographic photosensitive member includes a support, an undercoat layer, a photosensitive layer, and a surface layer, the undercoat layer containing a binder resin and strontium titanate particles, the surface layer being a cured film of a composition containing at least one compound selected from a guanamine compound and a melamine compound, and a charge transport material having at least one substituent selected from —OH, —$OCH_3$, —$NH_2$, —SH, and —COOH.

6 Claims, 3 Drawing Sheets

ELECTROPHOTOGRAPHIC PHOTOSENSITIVE MEMBER, PROCESS CARTRIDGE, AND ELECTROPHOTOGRAPHIC APPARATUS

BACKGROUND OF THE INVENTION

Field of the Invention

The present invention relates to an electrophotographic photosensitive member and a process cartridge and an electrophotographic apparatus each including the electrophotographic photosensitive member.

Description of the Related Art

A technique for disposing a cured surface layer on an electrophotographic photosensitive member has recently been studied in order to increase the mechanical strength of an electrophotographic photosensitive member used in an electrophotographic process, suppress the deterioration and wear of the photosensitive member, and maintain stable image quality over a long period of time. Regarding materials contained in the surface layer, Japanese Patent Laid-Open No. 2006-84711 discloses an electrophotographic photosensitive member including a cured film containing a specific additive and a phenolic resin, a melamine resin, a benzoguanamine resin, a siloxane resin, or a urethane resin. Japanese Patent Laid-Open No. 2009-31721 discloses an electrophotographic photosensitive member including cured film containing a reactive charge transport material having a specific substituent. Japanese Patent Laid-Open No. 2013-178367 discloses an electrophotographic photosensitive member including a cured film containing a melamine compound in addition to a guanamine compound.

Each of the electrophotographic photosensitive members disclosed in the foregoing Japanese Patent Laid-Open Publications can vary in electrical characteristics because of repeated use over a long period of time.

SUMMARY OF THE INVENTION

One aspect of the present invention is directed to providing an electrophotographic photosensitive member that can suppress variations in electrical characteristics due to repeated use over a long period of time.

Another aspect of the present invention is directed to providing a process cartridge that contributes to the stable formation of a high-quality electrophotographic image.

Yet another aspect of the present invention is directed to providing an electrophotographic apparatus that can stably form a high-quality electrophotographic image.

According to one aspect of the present invention, an electrophotographic photosensitive member includes a support, an undercoat layer, a photosensitive layer, and a surface layer, the undercoat layer containing a binder resin and strontium titanate particles, the surface layer being a cured film of a composition containing at least one compound selected from a guanamine compound, and a melamine compound, and a charge transport material having at least one substituent selected from —OH, —$OCH_3$, —$NH_2$, —SH, and —COOH.

According to another aspect of the present invention, a process cartridge attachable to and detachable from a main body of an electrophotographic apparatus includes an electrophotographic photosensitive member and at least one unit selected from the group consisting of a charging unit, a developing unit, and a cleaning unit, the process cartridge integrally supporting the electrophotographic photosensitive member and the at least one unit, the electrophotographic photosensitive member being the electrophotographic photosensitive member described above.

According to yet another aspect of the present invention, an electrophotographic apparatus includes an electrophotographic photosensitive member, a charging unit, an exposure unit, a developing unit, and a transfer unit, the electrophotographic photosensitive member being the electrophotographic photosensitive member described above.

Further features of the present invention will become apparent from the following description of exemplary embodiments with reference to the attached drawings.

DESCRIPTION OF THE EMBODIMENTS

Embodiments of the present invention will be described in detail below.

The inventors have first examined the reason why the technical problem of variations in electrical characteristics due to repeated use over a long period of time occurs in electrophotographic photosensitive members of the related art.

In the process of forming a surface layer, the surface layer may be exposed to a high-temperature environment of 150° C. or higher when the crosslinked structure of the surface layer is formed and cured. In the case where an undercoat layer, a photosensitive layer, and a surface layer are stacked on a support, the undercoat layer and the photosensitive layer are also exposed under the conditions for forming the surface layer. A lower temperature condition than that for forming the surface layer is usually sufficient to form the undercoat layer and the photosensitive layer. In the case where the surface layer is present, however, the undercoat layer and the photosensitive layer are exposed to a higher temperature than usual. The inventors thus speculate that alterations such as changes in the adhesion state of the interface between the photosensitive layer and the undercoat layer and the dispersed state of a metal oxide and a binder resin in the undercoat layer may occur.

Studies by the inventors indicate that the alterations described above are seemingly suppressed by allowing the undercoat layer to contain strontium titanate particles serving as a metal oxide and allowing the cured film to have a skeleton originating from a guanamine compound and a melamine compound.

Electrophotographic Photosensitive Member

Figure 1:
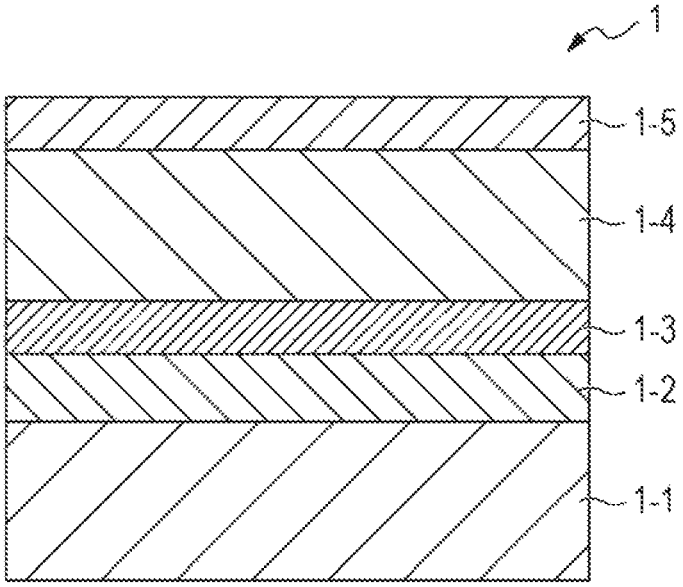
FIG. 1 illustrates an example of the layer structure of an electrophotographic photosensitive member according to an embodiment of the present invention.

An electrophotographic photosensitive member according to an embodiment of the present invention includes, for example, an undercoat layer on a support, a photosensitive layer on the undercoat layer, and a surface layer on the photosensitive layer as illustrated in FIG. 1. In FIG. 1, reference numeral 1-1 denotes the support, reference numeral 1-2 denotes the undercoat layer, reference numeral 1-3 denotes a charge generation layer, reference numeral 1-4 denotes the photosensitive layer, and reference numeral 1-5 denotes the surface layer.

For example, a method for producing an electrophotographic photosensitive member according to an embodiment of the present invention includes preparing coating liquids for the layers described below, sequentially applying the coating liquids for desired layers, and performing drying. Examples of a method for applying the coating liquids include dip coating, spray coating, inkjet coating, roll coating, die coating, blade coating, curtain coating, wire bar coating, and ring coating. Among these, dip coating can be used in view of efficiency and productivity.

Support

The electrophotographic photosensitive member according to an embodiment of the present invention includes a support. In an embodiment of the present invention, the support can be a conductive support having conductivity. Examples of the shape of the support include a cylindrical shape, a belt shape, and a sheet shape. Among these, a cylindrical support can be used. A surface of the support may be subjected to electrochemical treatment such as anodic oxidation, blasting treatment, or cutting treatment, and can be subjected to blasting treatment or cutting treatment.

As a material for the support, for example, a metal, a resin, or a glass can be used.

Examples of the metal include aluminum, iron, nickel, copper, gold, stainless steel, and alloys thereof. Among these, the support can be an aluminum support composed of aluminum.

Conductivity may be imparted to the resin and the glass by the incorporation or coating of a conductive material.

Conductive Layer

In an embodiment of the present invention, a conductive layer may be disposed on the support. The presence of the conductive layer enables the covering of scratches and irregularities of a surface of the support and enables the control of the reflection of light from the surface of the support.

The conductive layer can contain conductive particles and a resin.

Examples of a material of the conductive particles include metal oxide, metal, and carbon black.

Examples of the metal oxide include zinc oxide, aluminum oxide, indium oxide, silicon oxide, zirconium oxide, tin oxide, titanium oxide, magnesium oxide, antimony oxide, and bismuth oxide. Examples of the metal include aluminum, nickel, iron, Nichrome, copper, zinc, and silver.

Among these, the metal oxide can be used for the conductive particles. Specifically, titanium oxide, tin oxide, or zinc oxide can be used.

In the case of using the metal oxide as the conductive particles, the metal oxide may be surface-treated with, for example, a silane coupling agent or may be doped with an element such as phosphorus or aluminum or an oxide thereof.

Each of the conductive particles may have a layered structure including a core particle and a covering layer that covers the core particle. Examples of a material for the core particle include titanium oxide, barium sulfate, and zinc oxide. Examples of a material for the covering layer include metal oxides such as tin oxide.

In the case of using the metal oxide particles as the conductive particles, the metal oxide preferably has a volume-average particle size of 1 nm or more and 500 nm or less, more preferably 3 nm or more and 400 nm or less.

Examples of the resin include polyester resins, polycarbonate resins, polyvinyl acetal resins, acrylic resins, silicone resins, epoxy resins, melamine resins, polyurethane resins, phenolic resins, and alkyd resins.

Additionally, the conductive layer may further contain a masking agent such as a silicone oil, resin particles, or titanium oxide.

The conductive layer preferably has an average thickness of 1 μm or more and 50 μm or less, particularly preferably 3 μm or more and 40 μm or less.

The conductive layer can be formed by preparing a conductive layer coating liquid containing the foregoing materials and a solvent, forming a coating film, and drying the coating film. Examples of the solvent used for the coating liquid include alcoholic solvents, sulfoxide-based solvent, ketone-based solvents, ether-based solvents, ester-based solvents, and aromatic hydrocarbon-based solvents. An example of a method for dispersing the conductive particles in the conductive layer coating liquid is a method using a paint shaker, a sand mill, a ball mill, or a liquid collision high-speed disperser.

Undercoat Layer

In an embodiment of the present invention, the undercoat layer is disposed on the support or the conductive layer.

The undercoat layer of the electrophotographic photosensitive member according to an embodiment of the present invention contains strontium titanate particles and a binder resin. The undercoat layer according to an embodiment of the present invention may further contain an additive.

Strontium Titanate Particles

In an embodiment of the present invention, the strontium titanate particles preferably has a number-average primary particle size of 30 nm or more and 250 nm or less, more preferably 30 nm or more and 150 nm or less from the viewpoint of achieving good electrical characteristics.

The strontium titanate particles may be surface-treated with a surface treatment agent. Strontium titanate particles surface-treated with a silane coupling agent can be used. The silane coupling agent can have at least one functional group selected from the group consisting of an alkyl group, an amino group, and a halogen group from the viewpoint of achieving good electrical characteristics.

In an embodiment of the present invention, in a cross-sectional backscattered electron image of the undercoat layer captured using a scanning electron microscope at an acceleration voltage of 2.0 kV, the area of a region originating from the strontium titanate particles can be 50% or more and 90% or less based on the area of a region originating from a material other than the strontium titanate particles. Furthermore, the region originating from the strontium titanate particles can have an area of 0.001 $\mu m^2$ or more and 0.35 $\mu m^2$ or less.

Binder Resin

Examples of the binder resin include polyester resins, polycarbonate resins, polyvinyl acetal resins, acrylic resins, epoxy resins, melamine resins, polyurethane resins, phenolic resins, polyvinyl phenol resins, alkyd resins, polyvinyl alcohol resins, polyethylene oxide resins, polypropylene oxide resins, polyamide resins, polyamic acid resins, polyimide resins, polyamide-imide resins, and cellulosic resins.

The binder resin may be prepared by polymerizing a composition containing a monomer having a polymerizable functional group. Examples of the polymerizable functional group of the monomer having the polymerizable functional group include an isocyanate group, a blocked isocyanate group, a methylol group, an alkylated methylol group, an epoxy group, a metal alkoxide group, a hydroxy group, an amino group, a carboxy group, a thiol group, a carboxylic anhydride group, and a carbon-carbon double bond group.

Additive

In an embodiment of the present invention, the undercoat layer may contain an additive such as an electron transport material, a metal oxide, a metal, or a conductive polymer in order to improve electrical characteristics.

Examples of the electron transport material include quinone compounds, imide compounds, benzimidazole compounds, cyclopentadienylidene compounds, fluorenone compounds, xanthone compounds, benzophenone compounds, cyanovinyl compounds, halogenated aryl compounds, silole compounds, and boron-containing compounds. The undercoat layer may be formed in the form of a cured film by copolymerizing an electron transport material having a polymerizable functional group with the foregoing monomer having a polymerizable functional group.

Examples of the metal oxide include indium tin oxide, tin oxide, indium oxide, zinc oxide, aluminum oxide, and silicon dioxide. Examples of the metal include gold, silver, and aluminum.

The undercoat layer according to an embodiment of the present invention preferably has an average thickness of 0.1 μm or more and 40 μm or less, more preferably 0.5 μm or more and 20 μm or less.

The undercoat layer according to an embodiment of the present invention can be formed by preparing an undercoat layer coating liquid containing the foregoing materials and a solvent, forming a coating film thereof, and drying and/or curing the coating film. Examples of the solvent used for the coating liquid include alcoholic solvents, ketone-based solvents, ether-based solvents, ester-based solvents, and aromatic hydrocarbon-based solvents.

Photosensitive Layer

The electrophotographic photosensitive member according to an embodiment of the present invention includes a photosensitive layer on the undercoat layer.

The photosensitive layer of the electrophotographic photosensitive member is roughly classified into (1) a multilayer-type photosensitive layer and (2) a single-layer-type photosensitive layer. The multilayer-type photosensitive layer (1) includes a charge generation layer containing a charge generation material and a charge transport layer containing a charge transport material. The single-layer-type photosensitive layer (2) includes a photosensitive layer containing both of a charge generation material and a charge transport material.

(1) Multilayer-Type Photosensitive Layer

The multilayer-type photosensitive layer includes a charge generation layer and a charge transport layer.

(1-1) Charge Generation Layer

The charge generation layer can contain a charge generation material and a resin.

Examples of the charge generation material include azo pigments, perylene pigments, polycyclic quinone pigments, indigo pigments, and phthalocyanine pigments. Among these, azo pigments and phthalocyanine pigments can be used. Among phthalocyanine pigments, an oxytitanium phthalocyanine pigment, a chlorogallium phthalocyanine pigment, and a hydroxygallium phthalocyanine pigment can be used.

The charge generation layer preferably has a charge generation material content of 40% or more by mass and 85% or less by mass, more preferably 60% or more by mass and 80% or less by mass based on the total mass of the charge generation layer.

As the resin, a polyvinyl butyral resin can be used.

The charge generation layer may further contain an additive such as an antioxidant or an ultraviolet absorber. Specific examples thereof include hindered phenol compounds, hindered amine compounds, sulfur compounds, phosphorus compounds, and benzophenone compounds.

The charge generation layer preferably has an average thickness of 0.1 μm or more and 1 μm or less, more preferably 0.15 μm or more and 0.4 μm or less.

The charge generation layer can be formed by preparing a charge generation layer coating liquid containing the foregoing materials and a solvent, forming a coating film thereof, and drying the coating film. Examples of the solvent used for the coating liquid include alcoholic solvents, sulfoxide-based solvent, ketone-based solvents, ether-based solvents, ester-based solvents, and aromatic hydrocarbon-based solvents.

(1-2) Charge Transport Layer

The charge transport layer can contain a charge transport material and a resin.

Examples of the charge transport material include polycyclic aromatic compounds, heterocyclic compounds, hydrazone compounds, styryl compounds, enamine compounds, benzidine compounds, triarylamine compounds, and resins having groups derived from these materials. Among these, triarylamine compounds and benzidine compounds can be used.

The charge transport layer preferably has a charge transport material content of 25% or more by mass and 70% or less by mass, more preferably 30% or more by mass and 55% or less by mass based on the total mass of the charge transport layer.

Examples of the resin include polyester resins, polycarbonate resins, acrylic resins, and polystyrene resins. Among these, polycarbonate resins and polyester resins can be used. Among polyester resins, in particular, polyarylate resins can be used.

The ratio of the charge transport material content to the resin content (ratio by mass) is preferably 4:10 to 20:10, more preferably 5:10 to 12:10.

The charge transport layer may contain additives such as an antioxidant, an ultraviolet absorber, a plasticizer, a levelling agent, a sliding property-imparting agent, and a wear resistance improver. Specific examples thereof include hindered phenol compounds, hindered amine compounds, sulfur compounds, phosphorus compounds, benzophenone compounds, siloxane-modified resins, silicone oils, fluorine resin particles, polystyrene resin particles, polyethylene resin particles, silica particles, alumina particles, and boron nitride particles.

The charge transport layer preferably has an average thickness of 5 μm or more and 50 μm or less, more preferably 8 μm or more and 40 μm or less, particularly preferably 10 μm or more and 30 μm or less.

The charge transport layer can be formed by preparing a charge transport layer coating liquid containing the foregoing materials and a solvent, forming a coating film thereof, and drying the coating film. Examples of the solvent used for the coating liquid include alcoholic solvents, ketone-based solvents, ether-based solvents, ester-based solvents, and aromatic hydrocarbon-based solvents. Among these solvents, ether-based solvents or aromatic hydrocarbon-based solvents can be used.

(2) Single-Layer-Type Photosensitive Layer

The single-layer-type photosensitive layer can be formed by preparing a photosensitive layer coating liquid containing a charge generation material, a charge transport material, a resin, and a solvent, forming a coating film thereof, and drying the coating film. The charge generation material, the charge transport material, and the resin are similar to those described in "(1-1) Charge Generation Layer" of "(1) Multilayer-Type Photosensitive Layer". A polyvinyl butyral resin can be used.

Surface Layer

The electrophotographic photosensitive member according to an embodiment of the present invention includes a surface layer on the photosensitive layer, the surface layer being a cured film of a composition containing at least one compound selected from a guanamine compound and a melamine compound, and a charge transport material having at least one substituent selected from —OH, —$OCH_3$, —$NH_2$, —SH, and —COOH.

According to an embodiment of the present invention, the amount of the at least one compound selected from the guanamine compound and the melamine compound in the composition is preferably 0.1% or more by mass and 50.0% or less by mass, more preferably 1.0% or more by mass and 30.0% or less by mass based on the amount of the charge transport material in the composition. At an amount of less than 0.1% by mass, a dense film is not easily formed, thus possibly failing to achieve sufficient strength. At an amount of more than 50.0% by mass, the electrical characteristics and resistance to ghosting (uneven density due to an image history) are not sufficiently provided, in some cases.

Guanamine Compound

The guanamine compound according to an embodiment of the present invention refers to a compound having a guanamine skeleton. Examples thereof include acetoguanamine, benzoguanamine, formoguanamine, steroguanamine, spiroguanamine, and cyclohexylguanamine.

The guanamine compound may preferably be one selected from a compound represented by general formula (A) and its multimer. The reason for this is presumably that the absorption of a discharge-produced gas and water is suppressed because the compound has a functional group, corresponding to in the general formula A, imparting appropriate hydrophobicity to the surface layer, and that a highly cross-linked film is formed because up to four cross-linking regions (cross-linking sites) are present in a molecule:

(A)

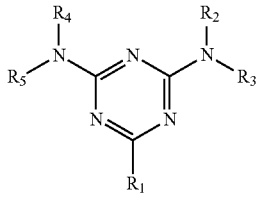

$R_1$ is an alkyl group having 1 or more and 10 or less carbon atoms, a phenyl group having 6 or more and 10 or less carbon atoms, or an alicyclic hydrocarbon group having 4 or more and 10 or less carbon atoms. In particular, $R_1$ can be a phenyl group having 6 or more and 10 or less carbon atoms.

$R_2$ to $R_5$ are each independently a hydrogen atom or —$CH_2$—O—$R_6$. $R_6$ is a hydrogen atom or an alkyl group having 1 or more and 10 or less carbon atoms. In particular, each of $R_2$ to $R_5$ can be —$CH_2$—O—$R_6$, and $R_6$ can be a methyl group or a n-butyl group.

The alkyl group may be linear or branched. The alkyl group, the phenyl group, and the alicyclic hydrocarbon group are optionally substituted.

When $R_1$ is an alkyl group, the alkyl group preferably has 1 or more and 8 or less carbon atoms, more preferably 1 or more and 5 or less carbon atoms.

When $R_1$ is a phenyl group, the phenyl group can have 6 or more and 8 or less carbon atoms. Examples of a substituent of the phenyl group include a methyl group, an ethyl group, and a propyl group.

When $R_1$ is an alicyclic hydrocarbon group, the alicyclic hydrocarbon group can have 5 or more and 8 or less carbon atoms. Examples of a substituent of the alicyclic hydrocarbon group include a methyl group, an ethyl group, and a propyl group.

When $R_6$ is an alkyl group, the alkyl group preferably has 1 or more and 8 or less carbon atoms, more preferably 1 or more and 6 or less carbon atoms. Examples of a substituent of the alkyl group include a methyl group, an ethyl group, and a butyl group.

As a method for synthesizing a compound represented by general formula (A), any known method may be employed. An example thereof is a method in which guanamine and formaldehyde are used.

The multimer of the compound represented by general formula (A) is a compound obtained by polymerizing multiple molecules of the compound represented by general formula (A). The degree of polymerization of the multimer is preferably 2 or more and 200 or less, more preferably 2 or more and 100 or more. The compound represented by general formula (A) may be of a single type. Alternatively, two or more compounds represented by general formula (A) may be used in combination. In particular, a mixture or multimer of two or more compounds represented by general formula (A) can be used because the solubility in a solvent is improved.

Specific examples of the compound represented by general formula (A) are illustrated below. Although these specific examples illustrated below are monomers, multimers thereof may also be used. In the exemplified compounds illustrated below, "Me" denotes a methyl group, "Bu" denotes a butyl group, and "Ph" denotes a phenyl group.

(A)-1

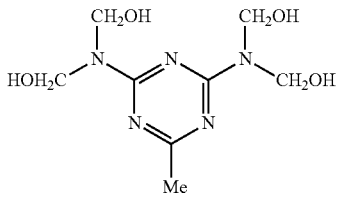

(A)-2

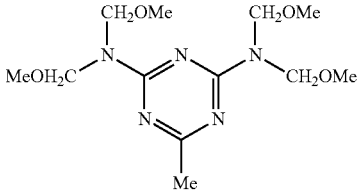

-continued
(A)-3
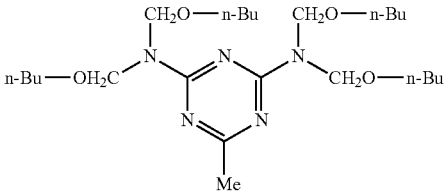
(A)-4
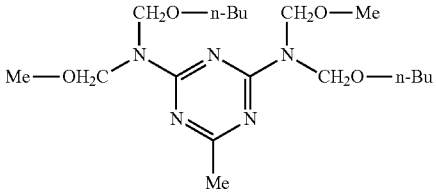
(A)-5
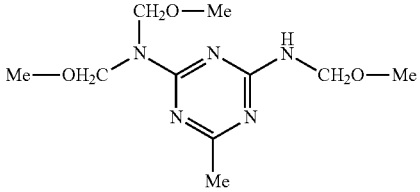
(A)-6
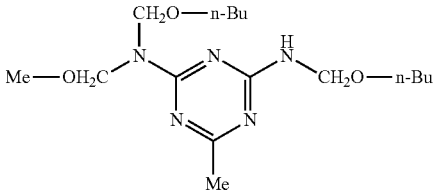
(A)-7
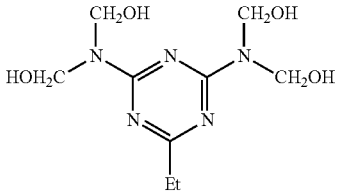
(A)-8
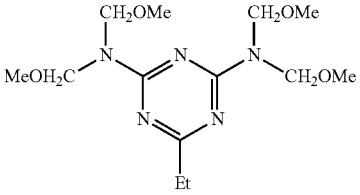
(A)-9
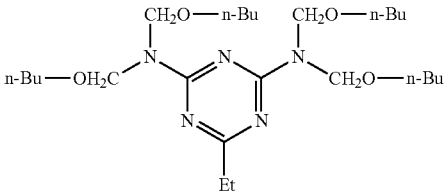
(A)-10
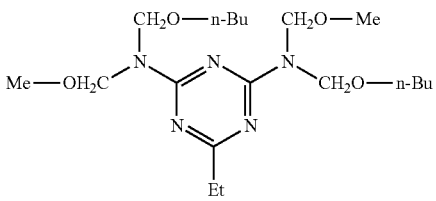
-continued
(A)-11
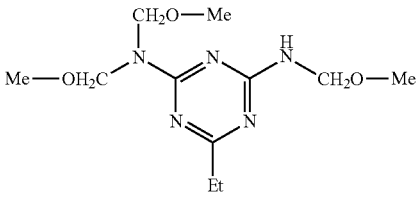
(A)-12
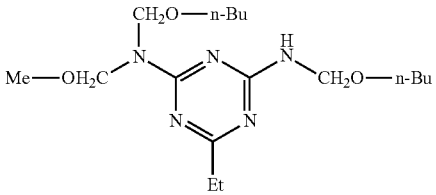
(A)-13
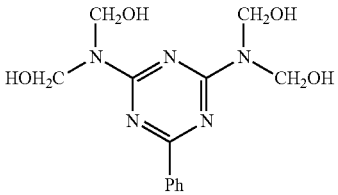
(A)-14
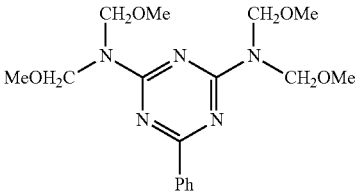
(A)-15
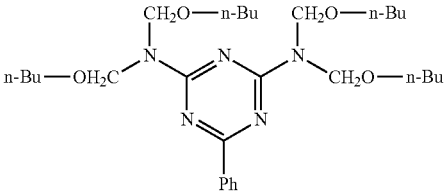
(A)-16
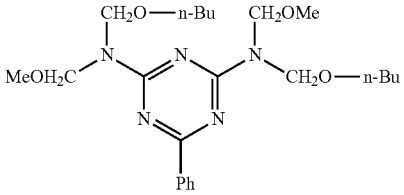
(A)-17
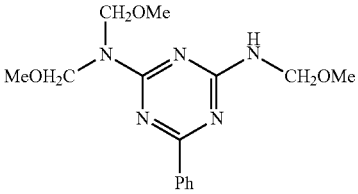
(A)-18
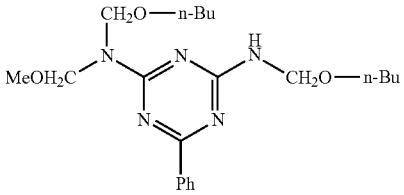

-continued
(A)-19
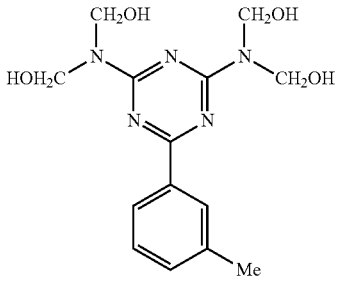
(A)-20
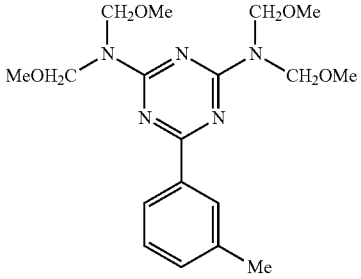
(A)-21
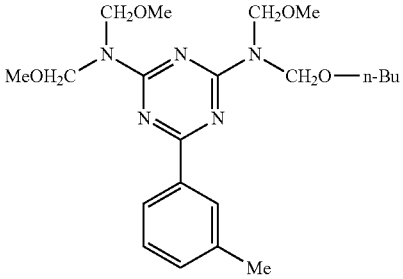
(A)-22
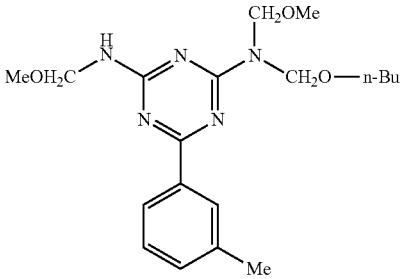
(A)-23
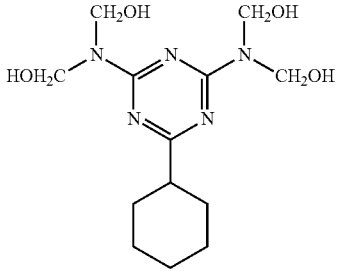
-continued
(A)-24
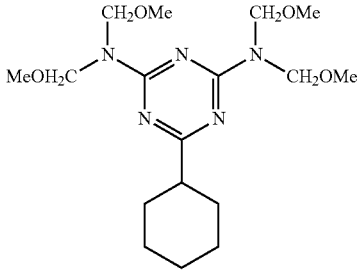
(A)-25
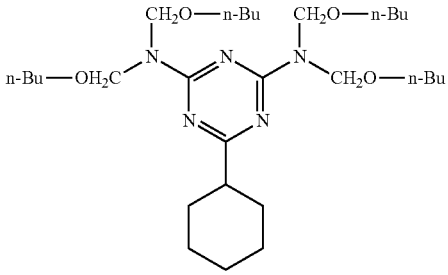
(A)-26
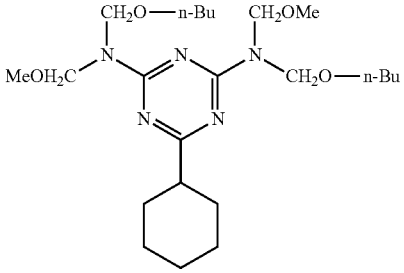
(A)-27
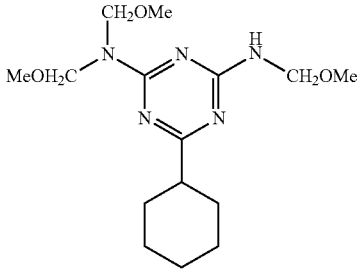
(A)-28
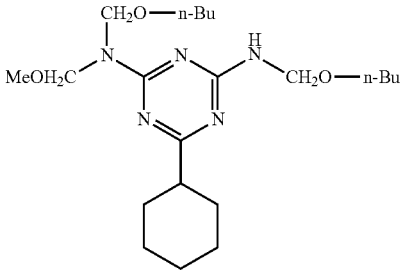

-continued
(A)-29
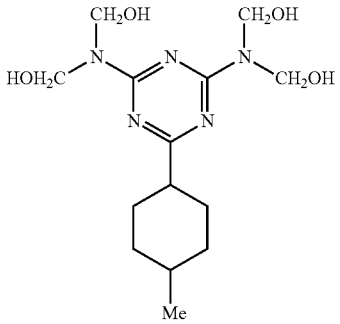
(A)-30
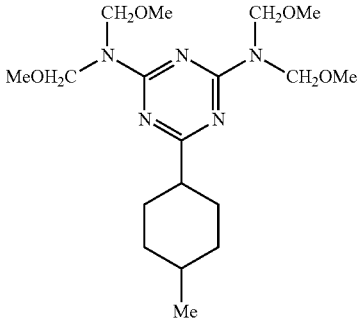
(A)-31
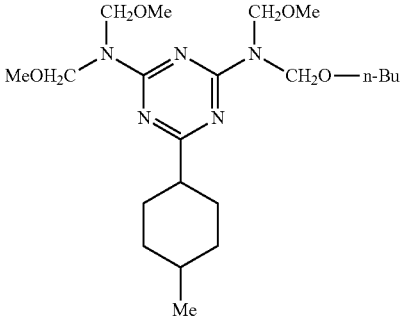
(A)-32
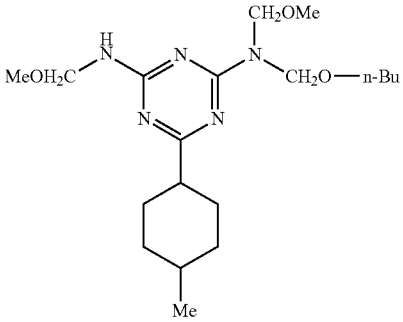
(A)-33
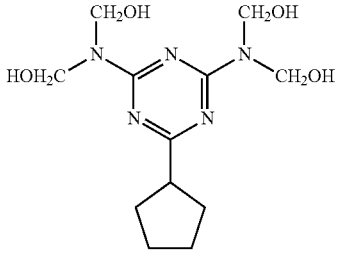
-continued
(A)-34
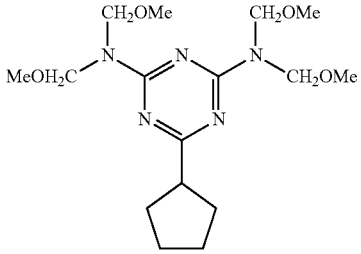
(A)-35
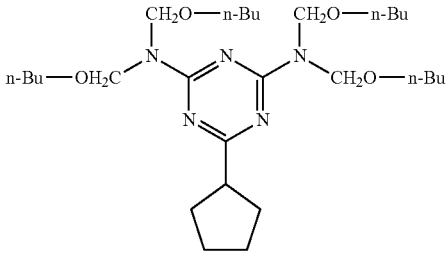
(A)-36
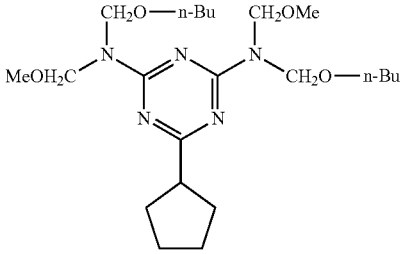
(A)-37
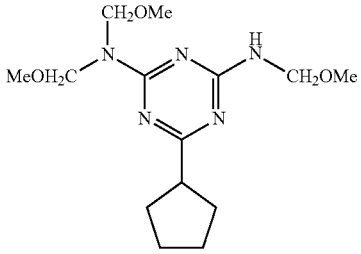
(A)-38
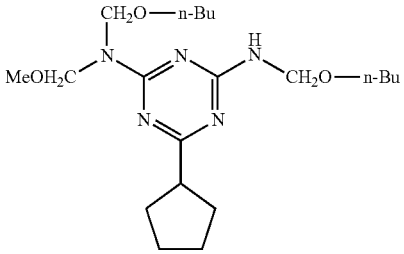
(A)-39
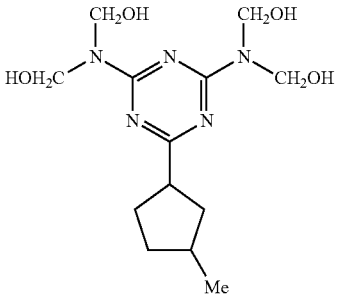

-continued (A)-40

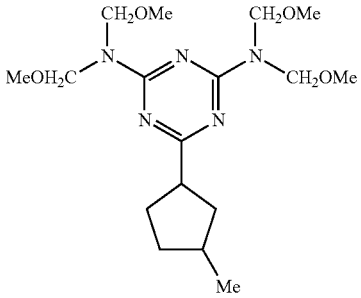

(A)-41

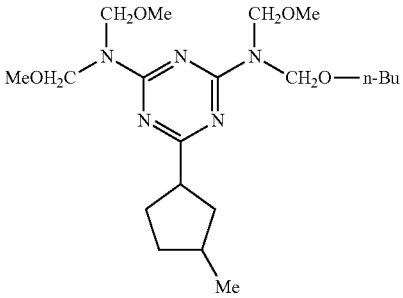

(A)-42

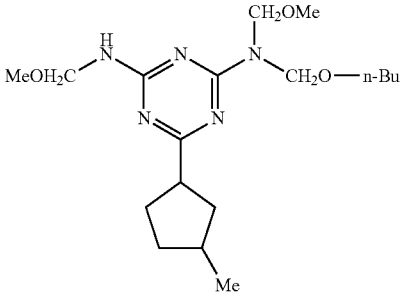

Examples of a commercially available compound represented by general formula (A) include Super Beckamine® L-148-55, Super Beckamine® 13-535, Super Beckamine® L-145-60, and Super Beckamine® TD-126 (available from DIC Corporation); and Nikalack BL-60 and Nikalack BX-4000 (available from Nippon Carbide Industries Co., Inc).

To remove the influence of a residual catalyst after synthesis or the purchase of a commercial item, the compound represented by general formula (A) may be dissolved in an appropriate solvent such as toluene, xylene, or ethyl acetate and washed with, for example, distilled water or deionized water or may be treated with an ion-exchange resin.

Melamine Compound

The melamine compound includes a compound having a melamine skeleton. In particular, the melamine compound may preferably be one selected from a compound represented by general formula (B) and its multimer.

(B)

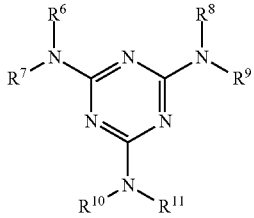

$R_6$ to $R_{11}$ are each independently a hydrogen atom, —$CH_2$—OH, —$CH_2$—O—$R_{12}$, or —O—$R_{12}$.

$R_{12}$ is an alkyl group having 1 or more and 5 or less carbon atoms. The alkyl group may be linear or branched and may be, for example, a methyl group, an ethyl group, or a butyl group.

As a method for synthesizing a compound represented by general formula (B), any known method may be employed. An example thereof is a method in which melamine and formaldehyde are used.

The multimer of the compound represented by general formula (B) is a compound obtained by polymerizing multiple molecules of the compound represented by general formula (B). The degree of polymerization of the multimer is preferably 2 or more and 200 or less, more preferably 2 or more and 100 or more. The compound represented by general formula (B) may be of a single type. Alternatively, two or more compounds represented by general formula (B) may be used in combination. In particular, a mixture or multimer of two or more compounds represented by general formula (B) can be used because the solubility in a solvent is improved.

Specific examples of the compound represented by general formula (B) are illustrated below. Although these specific examples illustrated below are monomers, multimers thereof may also be used.

(B)-1

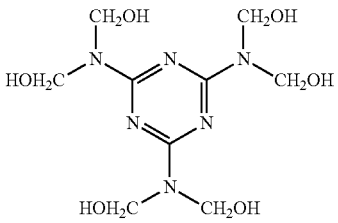

(B)-2

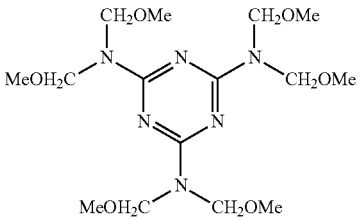

(B)-3

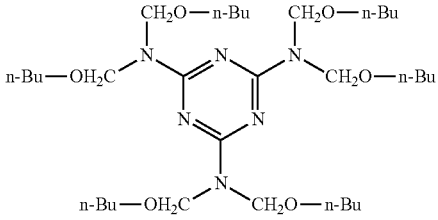

-continued (B)-4

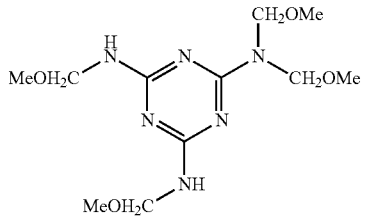

(B)-5

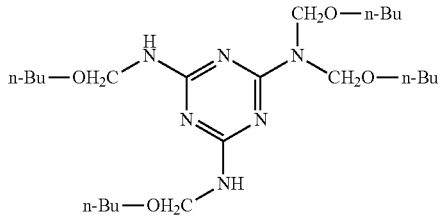

(B)-6

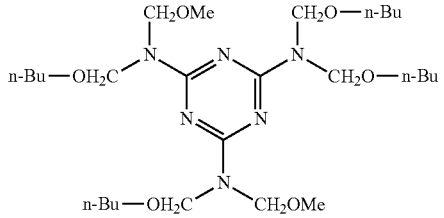

(B)-7

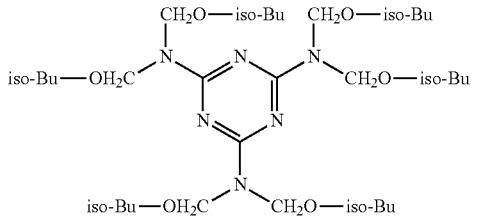

(B)-8

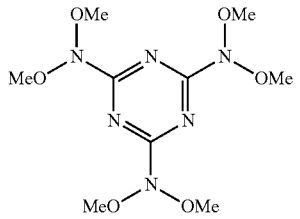

Examples of a commercially available compound represented by general formula (B) include Supermelami No. 90 (available from NOF Corporation), Super Beckamine® TD-139-60 (available from DIC Corporation), U-VAN 2020 (available from Mitsui Chemicals, Inc.), Sumitex Resin M-3 (available from Sumitomo Chemical Co., Ltd.), and Nikalack MW-30 (available from Nippon Carbide Industries Co., Inc).

To remove the influence of a residual catalyst after synthesis or the purchase of a commercial item, the compound (including its multimer) represented by general formula (B) may be dissolved in an appropriate solvent such as toluene, xylene, or ethyl acetate and washed with, for example, distilled water or deionized water or may be treated with an ion-exchange resin.

Charge Transport Material Containing at Least One Substituent Selected from —OH, —$OCH_3$, —$NH_2$, —SH, and —COOH The charge transport material according to an embodiment of the present invention has at least one substituent (hereinafter, also referred to as "reactive group") selected from —OH, —$OCH_3$, —$NH_2$, —SH, and —COOH. In particular, the charge transport material can have at least three reactive groups. The reason for this is presumably as follows: The increase of the number of the reactive groups in a specific charge transport material increases the crosslinking density to provide a crosslinked film having higher strength, thereby reducing the rotation torque of the electrophotographic photosensitive member, in particular, when a blade cleaner is used, reducing damage to the blade, and reducing the wear of the electrophotographic photosensitive member.

The charge transport material according to an embodiment of the present invention can be a compound represented by general formula (I):

$$F—((—R_7—X)_{n1}R_8—Y)_{n2} \quad (I)$$

where in general formula (I), F is an organic group derived from a compound having charge transportability, $R_7$ and $R_8$ are each independently a linear or branched alkylene group having 1 or more and 5 or less, X is an oxygen atom, NH, or a sulfur atom, Y is —OH, —$OCH_3$, —$NH_2$, —SH, or —COOH, n1 is 0 or 1, and n2 is an integer of 1 or more and 4 or less.

In general formula (I), examples of the compound, from which the organic group denoted by F is derived, having charge transportability can include arylamine derivatives. Examples of arylamine derivatives include triphenylamine derivatives and tetraphenylbenzidine.

Specific examples of the compound represented by general formula (I) include exemplified compounds illustrated below.

1-1

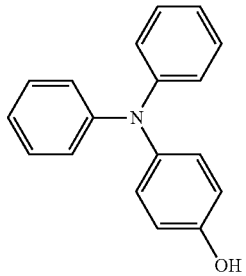

1-2

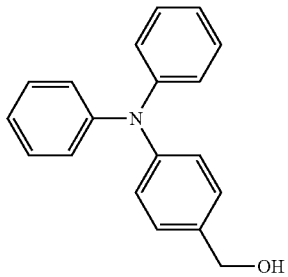

1-3

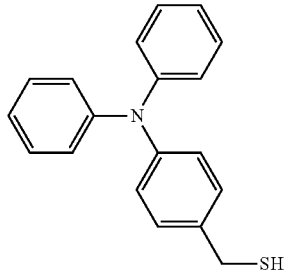

-continued
1-4
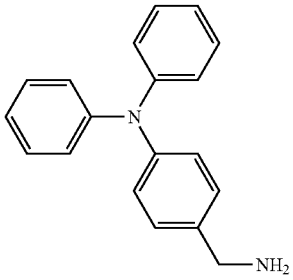
1-5
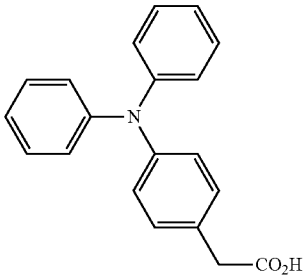
1-6
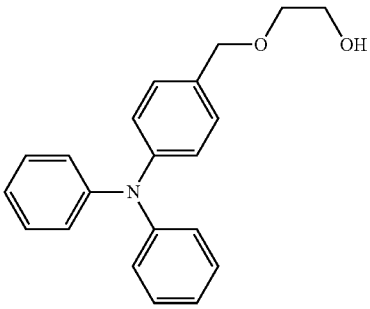
1-7
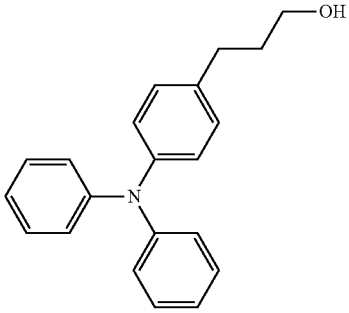
1-8
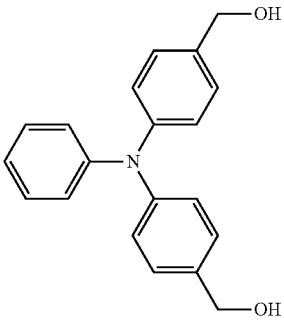
-continued
1-9
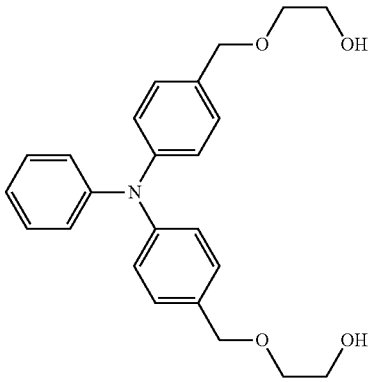
1-10
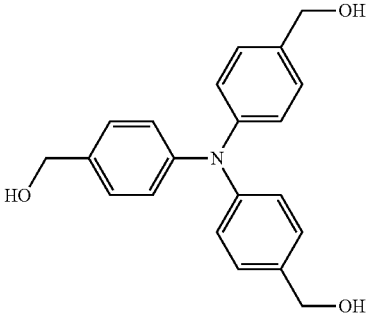
1-11
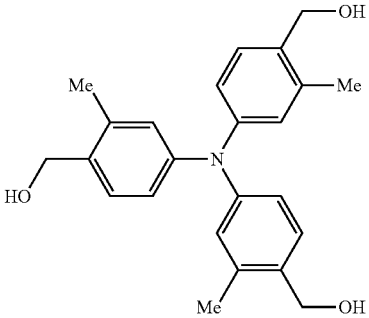
1-12
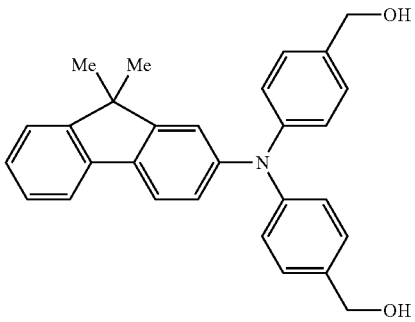

-continued
1-13
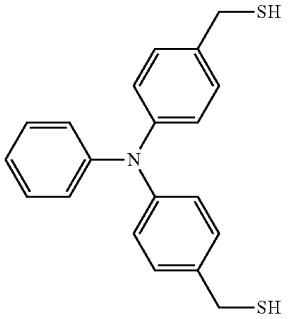
1-14
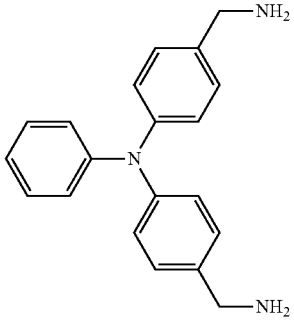
1-15
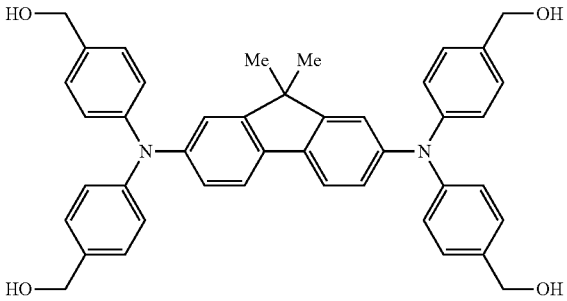
1-16
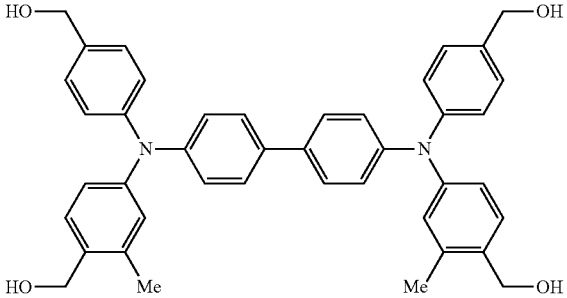
1-17
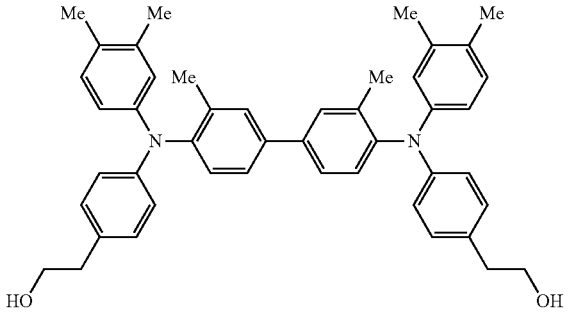
-continued
1-18
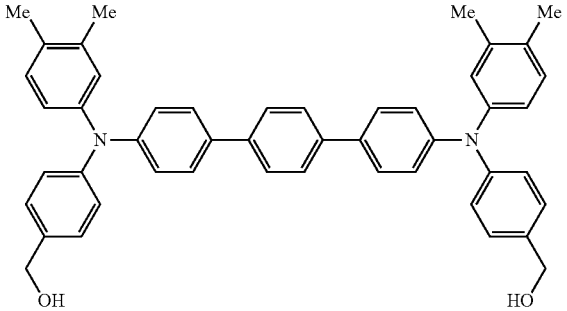
1-19
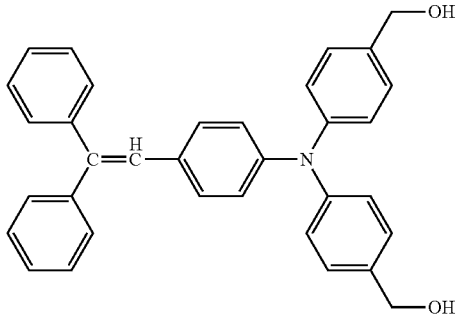
1-20
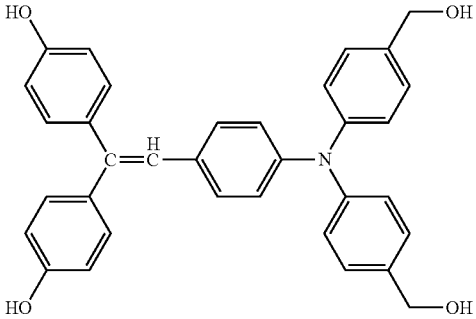
1-21
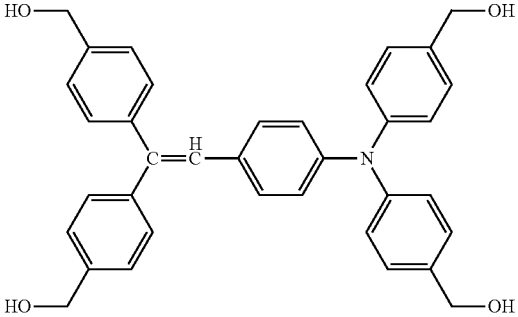

-continued
1-22
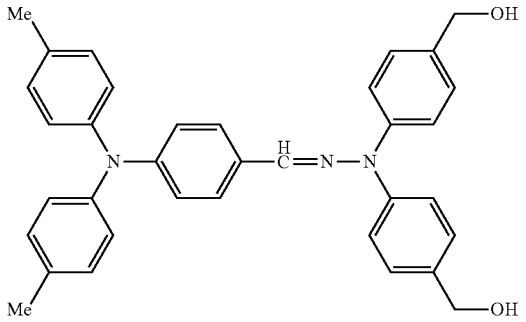
1-23
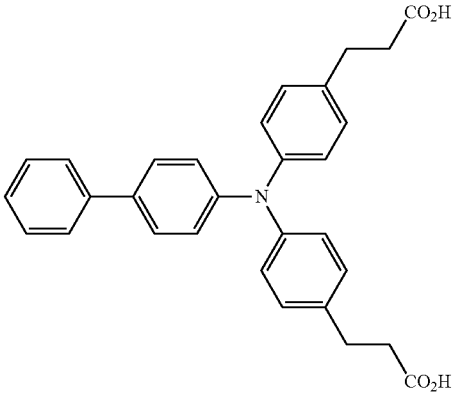
1-24
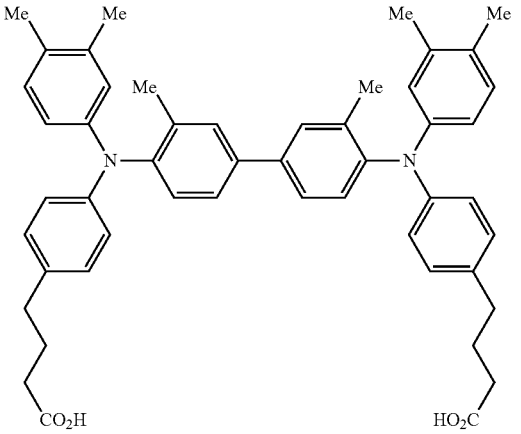
1-25
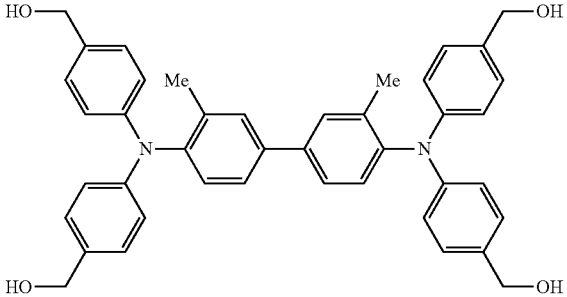
-continued
1-26
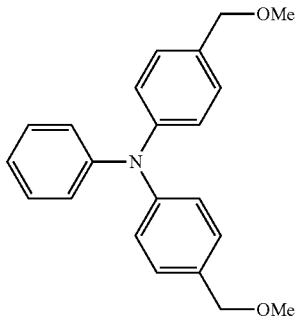
1-27
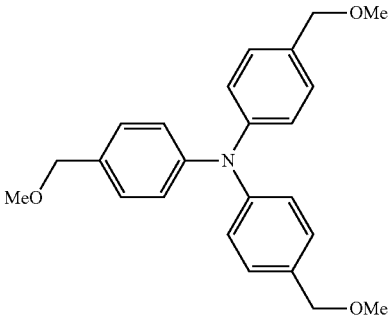
1-28
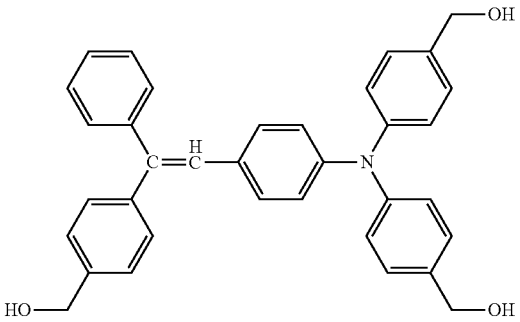
1-29
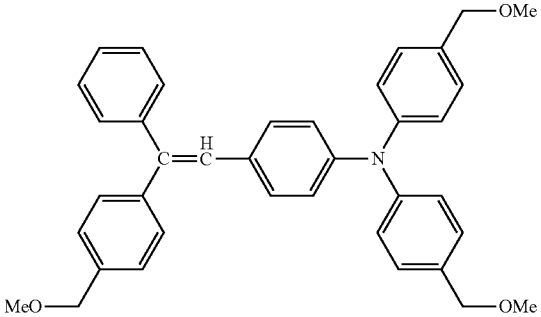

-continued 1-30

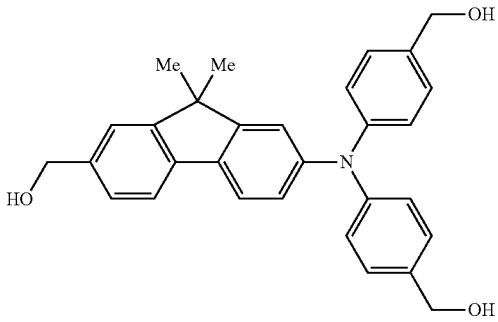

1-31

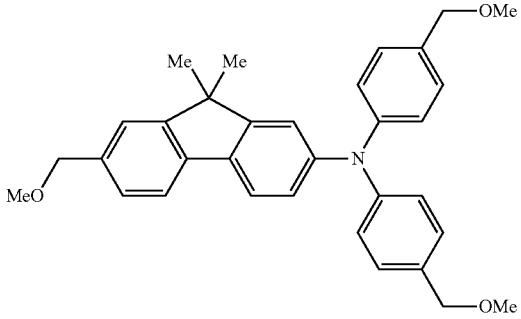

1-32

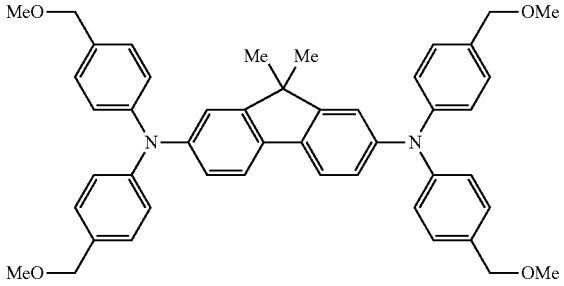

1-33

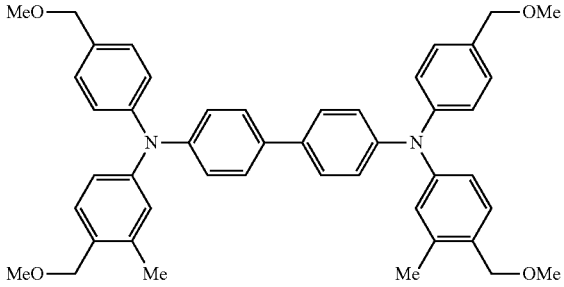

1-34

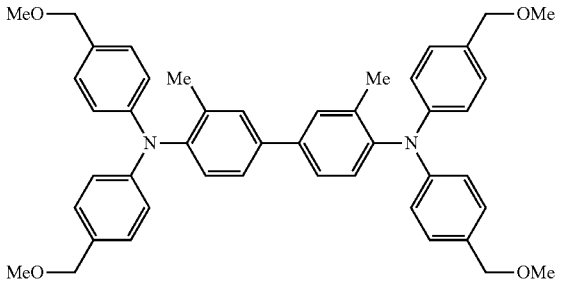

Surface Processing of Electrophotographic Photosensitive Member

To further stabilize the behavior of a cleaning unit (cleaning blade) to be brought into contact with the electrophotographic photosensitive member, the electrophotographic photosensitive member according to an embodiment of the present invention may include depressed portions or protruding portions on the surface layer. Furthermore, the surface layer may be ground to form a rough surface.

In the case where depressed portions are formed, the depressed portions can be formed on a surface of the electrophotographic photosensitive member by bringing a mold having protruding portions corresponding to the depressed portions into pressure contact with the surface of the electrophotographic photosensitive member to perform shape transfer. In the case where the protruding portions are formed, the protruding portions can be formed on the surface of the electrophotographic photosensitive member by bringing a mold having depressed portions corresponding to the protruding portions into pressure contact with the surface of the electrophotographic photosensitive member to perform shape transfer. In the case where the surface layer of the electrophotographic photosensitive member is ground to form a rough surface, the rough surface can be formed by bringing a grinding tool into contact with the electrophotographic photosensitive member and relatively moving one or both of them to grind the surface of the electrophotographic photosensitive member. An example of the grinding tool is a grinding member including a layer containing abrasive particles dispersed in a binder resin on a base.

Process Cartridge and Electrophotographic Apparatus

A process cartridge according to an embodiment of the present invention includes the electrophotographic photosensitive member described above and at least one unit selected from the group consisting of a charging unit, a developing unit, a transfer unit, and a cleaning unit, the process cartridge integrally supporting the electrophotographic photosensitive member and the at least one unit and being attachable to and detachable from the main body of an electrophotographic apparatus.

An electrophotographic apparatus according to an embodiment of the present invention includes the electrophotographic photosensitive member described above, a charging unit, an exposure unit, a developing unit, and a transfer unit.

Figure 2:
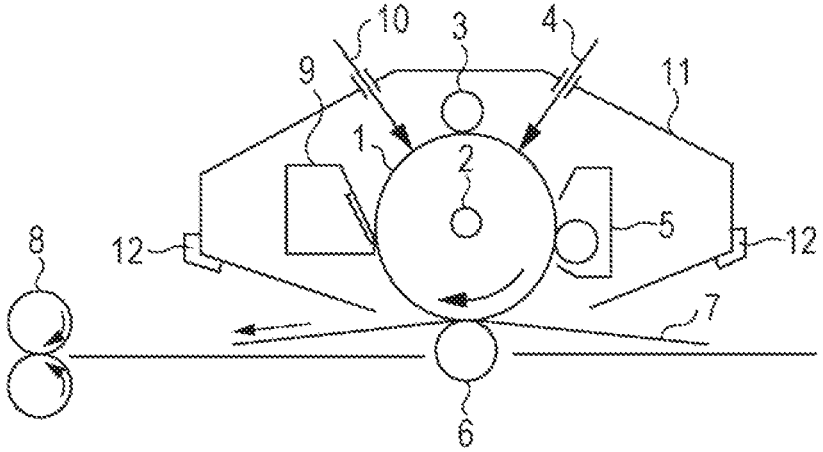
FIG. 2 illustrates an example of an electrophotographic apparatus including a process cartridge that includes an electrophotographic photosensitive member according to an embodiment of the present invention.

FIG. 2 illustrates an example of a schematic structure of an electrophotographic apparatus including a process cartridge that includes an electrophotographic photosensitive member.

Reference numeral 1 denotes a cylindrical electrophotographic photosensitive member that is rotationally driven around a shaft 2 at a predetermined circumferential velocity in the direction indicated by an arrow. A surface of the electrophotographic photosensitive member 1 is charged to a predetermined positive or negative potential with a charging unit 3. Although a roller charging method with a roller charging member is illustrated in the figure, a charging method such as a corona charging method, a proximity charging method, or an injection charging method may be employed. In the case of the roller charging method, there are a DC charging method in which a roller charging member receives only a direct-current voltage applied and an AC/DC charging method in which an alternating voltage is superimposed on a direct-current voltage. The DC charging method can be employed from the viewpoint of achieving reductions in cost and size of the apparatus. The surface of the electrophotographic photosensitive member 1 is irradiated with exposure light 4 from an exposure unit (not illustrated) to form an electrostatic latent image corresponding to target image information. The electrostatic latent image formed on the surface of the electrophotographic photosensitive member 1 is developed with toner accommodated in a developing unit 5 to form a toner image on the surface of the electrophotographic photosensitive member 1. The toner image formed on the surface of the electrophotographic photosensitive member 1 is transferred to a transfer material 7 with a transfer unit 6. The transfer material 7 receiving the toner image is conveyed to a fixing unit 8, subjected to the fixing treatment of the toner image, and conveyed to the outside of the electrophotographic apparatus. The electrophotographic apparatus may include a cleaning unit 9 to remove adherents such as toner left on the surface of the electrophotographic photosensitive member 1 after the transfer. A cleaner-less system may be used in which the adherents are removed with the developing unit without providing a cleaning unit separately. The electrophotographic apparatus may include a charge elimination mechanism to eliminate charges on the surface of the electrophotographic photosensitive member 1 with pre-exposure light 10 from a pre-exposure unit (not illustrated). Additionally, guiding units 12, such as rails, used to attach or detach a process cartridge according to an embodiment of the present invention from the main body of the electrophotographic apparatus may be disposed.

The electrophotographic photosensitive member according to an embodiment of the present invention can be used for laser beam printers, LED printers, copiers, facsimiles, and multifunction apparatuses thereof.

According to an embodiment of the present invention, it is possible to provide the electrophotographic photosensitive member that can suppress variations in electrical characteristics due to repeated use over a long period of time.

According to another embodiment of the present invention, it is possible to provide the process cartridge that contributes to the stable formation of a high-quality electrophotographic image. According to yet another embodiment of the present invention, it is possible to provide the electrophotographic apparatus that can stably form a high-quality electrophotographic image.

EXAMPLES

The present invention will be described in more detail below by examples and comparative examples. The present invention is not limited to the following examples as long as it is within the scope of the present invention. In the description of the examples, "part(s)" is on a mass basis, unless otherwise specified.

Production Example of Strontium Titanate Particles

Production Example of Particles S-1

An aqueous solution containing a 1.1-fold molar amount of strontium chloride was added to 1.8 mol of a titania sol dispersion (on a titanium oxide basis). The mixture was charged into a reaction vessel, and the atmosphere in the vessel was replaced with nitrogen gas. Deionized water was added to the mixture in such a manner that the concentration was 0.9 mol/L on a titanium oxide basis.

After the mixture was stirred and heated to 80° C., 792 mL of a 5 N aqueous solution of sodium hydroxide was added thereto over a period of 40 minutes while applying ultrasonic vibration. Then a reaction was performed for 20 minutes. After the reaction, the resulting slurry was cooled to 30° C. or lower, the supernatant liquid was removed. Hydrochloric acid with a pH of 5.0 was added to the slurry. The resulting slurry was stirred for 1 hour and then repeatedly washed with deionized water. After the slurry was neutralized with sodium hydroxide, the slurry was filtered with a Nutsche filter and washed with deionized water. The resulting cake was dried to give particles S-1. The resulting particles had a number-average primary particle size of 35 nm.

Production Example of Particles S-2

An aqueous solution containing a 1.1-fold molar amount of strontium chloride was added to 2.2 mol of a titania sol dispersion (on a titanium oxide basis). The mixture was charged into a reaction vessel, and the atmosphere in the vessel was replaced with nitrogen gas. Deionized water was added to the mixture in such a manner that the concentration was 1.1 mol/L on a titanium oxide basis. After the mixture was stirred and heated to 90° C., 440 mL of a 10 N aqueous solution of sodium hydroxide was added thereto over a period of 15 minutes while applying ultrasonic vibration. Then a reaction was performed for 20 minutes. After the reaction, the resulting slurry was rapidly cooled to 30° C. or lower by the addition of deionized water with a temperature of 5° C. to the reaction mixture, the supernatant liquid was removed. Hydrochloric acid with a pH of 5.0 was added to the slurry. The resulting slurry was stirred for 1 hour and then repeatedly washed with deionized water. After the slurry was neutralized with sodium hydroxide, the slurry was filtered with a Nutsche filter and washed with deionized water. The resulting cake was dried to give particles S-2. The resulting particles had a number-average primary particle size of 110 nm.

Production Example of Surface-Treated Strontium Titanate Particles

Production Example of Surface-Treated Particles S-1A

Next, 100 parts of particles S-1 produced above were mixed with 500 parts of toluene under stirring, and then 2 parts of N-2-(aminoethyl)-3-aminopropylmethyldimethoxysilane (trade name: KBM-602, available from Shin-Etsu Chemical Co., Ltd.) serving as a silane coupling agent was added thereto. The mixture was stirred for 6 hours. Toluene was removed under reduced pressure. The residue was dried by heating at 130° C. for 6 hours to give surface-treated particles S-1A.

Production Example of Surface-Treated Particles S-1B

Surface-treated particles S-1B were produced as in the production example of the surface-treated particles S-1A, except that the amount of the silane coupling agent added was changed to 0.75 parts.

Production Example of Surface-Treated Particles S-1C

Surface-treated particles S-1C were produced as in the production example of the surface-treated particles S-1A, except that the amount of the silane coupling agent added was changed to 5 parts.

Production Example of Surface-Treated Particles S-1D

Surface-treated particles S-1D were produced as in the production example of the surface-treated particles S-1A, except that the silane coupling agent was changed to N-2-(aminoethyl)-3-aminopropyltrimethoxysilane (trade name: KBM-603, available from Shin-Etsu Chemical Co., Ltd).

Production Example of Surface-Treated Particles S-1E

Surface-treated particles S-1E were produced as in the production example of the surface-treated particles S-1A, except that the silane coupling agent was changed to 4.6 parts of isobutyltrimethoxysilane and 4.6 parts of trifluoropropylmethoxysilane.

Production Example of Surface-Treated Particles S-2A

Surface-treated particles S-2A were produced as in the production example of the surface-treated particles S-1A, except that the particles S-1 were changed to the particles S-2.

Example 1

An aluminum cylinder having a length of 357.5 mm, a thickness of 0.7 mm, and an outside diameter of 30 mm was provided as a support (conductive support). A surface of the aluminum cylinder was subjected to cutting treatment on a lathe. The cutting treatment was performed using a cutting tool with a corner radius R of 0.1 and a main spindle rotation speed of 10,000 rpm while the tool feed rate varied continuously in the range of 0.03 to 0.06 mm/rpm.

Production of Undercoat Layer

Next, 15 parts of a butyral resin (trade name: BM-1, available from Sekisui Chemical Co., Ltd.) serving as a polyol resin and 15 parts of a blocked isocyanate (tradename: Sumidur 3175, available from Sumika Bayer Urethane Co., Ltd.) were dissolved in a mixture of 300 parts of methyl ethyl ketone and 300 parts of 1-butanol. To the resulting mixture, 120 parts of the particles S-1A serving as strontium titanate particles and 1.2 parts of 2,3,4-trihydroxybenzophenone (available from Tokyo Chemical Industry Co., Ltd.) serving as an additive were added. The mixture was dispersed in an atmosphere with a temperature of 23±3° C. for 3 hours with a sand mill using glass beads having a diameter of 0.8 mm. After dispersion, 0.01 parts of a silicon oil (trade name: SH28PA, available from Dow Corning Toray Co., Ltd.) was added to the dispersion. The mixture was stirred to prepare an undercoat layer coating liquid. The undercoat layer coating liquid was applied to the support by dipping and dried at 160° C. for 30 minutes to form an undercoat layer having a thickness of 18 μm. A cross section of the layer formed was observed with a scanning electron microscope (SEM, available from HORIBA, Ltd). The average particle cross-sectional area of the strontium titanate particles dispersed in the cross section of the layer was determined and found to be 0.05 $\mu m^2$.

Production of Charge Generation Layer

Next, 20 parts of hydroxygallium phthalocyanine crystals, serving as a charge generation material, with a crystal form exhibiting a strong peak at 7.4° and 28.2°, which were Bragg angles 2θ±0.2°, in a characteristic X-ray diffraction pattern measured with CuKα radiation, 0.2 parts of a calixarene compound represented by the following formula:

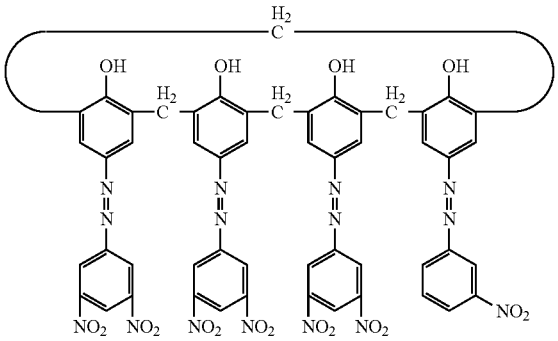

10 parts of a polyvinyl butyral resin (trade name: S-Lec BX-1, available from Sekisui Chemical Co., Ltd.), and 600 parts of cyclohexanone were placed in a sand mill using glass beads having a diameter of 1 mm. The mixture was subjected to dispersion treatment for 4 hours. Then 600 parts of ethyl acetate was added thereto, thereby preparing a charge generation layer coating liquid. The charge generation layer coating liquid was applied to the undercoat layer by dipping. The resulting coating film was dried at 80° C. for 15 minutes to form a charge generation layer having a thickness of 0.19 μm.

Production of Charge Transport Layer

Next, 60 parts of a compound (charge transport material) represented by the following formula:

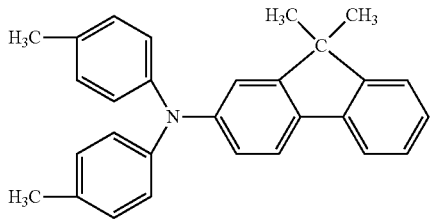

30 parts of a compound (charge transport material) represented by the following formula:

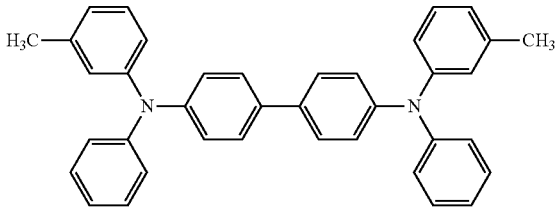

10 parts of a compound represented by the following formula:

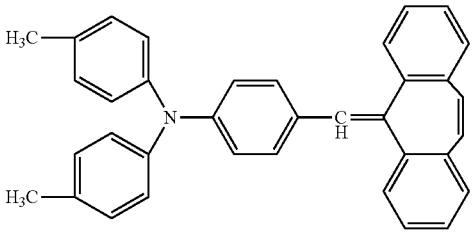

100 parts of a polycarbonate resin (trade name: Iupilon Z400, bisphenol Z-type polycarbonate, available from Mitsubishi Engineering-Plastics Corporation), and 0.02 parts of a polycarbonate (viscosity-average molecular weight Mv: 20,000) represented by the following formula:

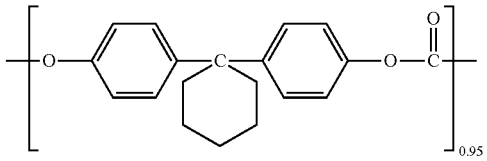

-continued

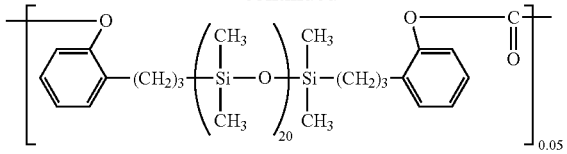

were dissolved in a solvent mixture of 600 parts of o-xylene and 200 parts of dimethoxymethane to prepare a charge transport layer coating liquid.

The charge transport layer coating liquid was applied to the charge generation layer by dipping to form a coating film. The resulting coating film was dried at 100° C. for 30 minutes to form a charge transport layer having a thickness of 18 μm.

Production of Surface Layer

Next, 3 parts by mass of guanamine resin (exemplified compound (A-14)), 3 parts by mass of a compound represented by (I-16), 0.3 parts by mass of colloidal silica (trade name: PL-1, available from Fuso Chemical Co., Ltd.), 0.2 parts by mass of a polyvinyl phenol resin (weight-average molecular weight: about 8,000, available from Sigma-Aldrich Corporation), 8 parts by mass of 1-methoxy-2-propanol, 0.2 parts by mass of 3,5-di-tert-butyl-4-hydroxytoluene (BHT), and 0.01 parts by mass of p-toluenesulfonic acid were mixed together to prepare a surface layer coating liquid. The coating liquid was applied to the charge transport layer by dipping, air-dried at room temperature (25° C.) for 30 minutes, and cured by heating at 150° C. for 1 hour to form a surface layer having a thickness of about 7 μm, thereby producing a photosensitive member of Example 1.

Formation of Depressed Portion by Pressure-Contact Shape Transfer with Mold

A mold member (mold) was placed on a pressure-contact shape transfer processing apparatus. The produced electrophotographic photosensitive member before the formation of depressed portions was subjected to surface processing.

Figure 3A:
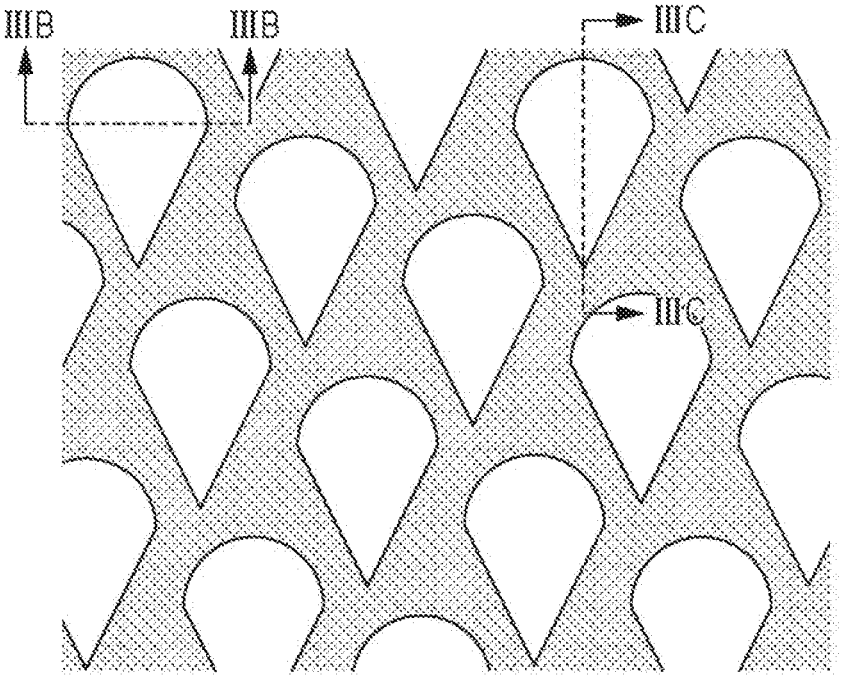
FIG. 3A is a top view illustrating a mold used in a production example of an electrophotographic photosensitive member.
Figure 3B:
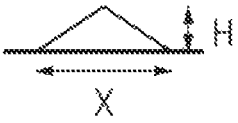
FIG. 3B is a sectional view taken along line IIIB-IIIB of FIG. 3A, the view illustrating a protruding portion of the mold in FIG. 3A.
Figure 3C:
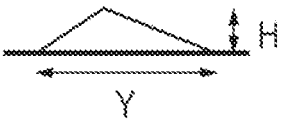
FIG. 3C is a sectional view taken along line IIIC-IIIC of FIG. 3A, the view illustrating a protruding portion of the mold in FIG. 3A.
Figure 4:
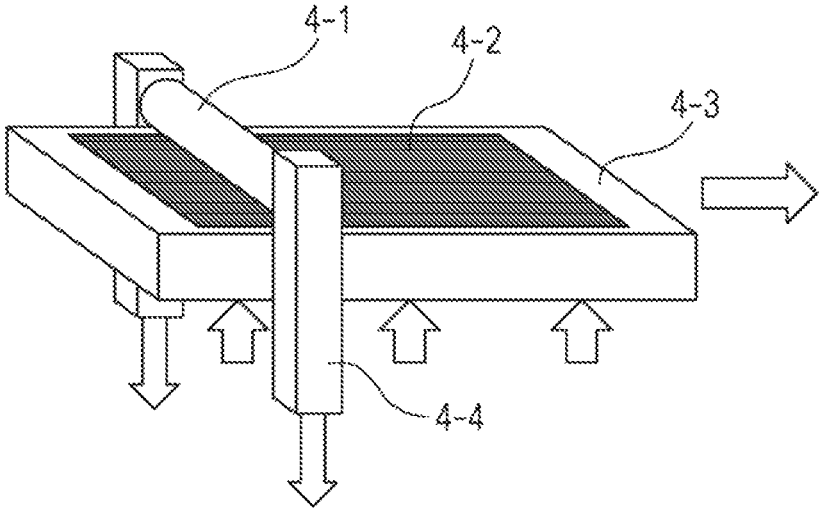
FIG. 4 illustrates an example of a pressure-contact shape transfer processing apparatus for forming depressed portions on the peripheral surface of an electrophotographic photosensitive member.

Specifically, a mold illustrated in FIG. 3A was installed in a pressure-contact shape transfer processing apparatus having a configuration as schematically illustrated in FIG. 4. Surface processing was performed on the resulting electrophotographic photosensitive member before the formation of the depressed portions. FIGS. 3A to 3C illustrate the mold used in examples and comparative examples. FIG. 3A is a top view schematically illustrating the mold. FIG. 3B is a schematic sectional view of protruding portions of the mold in the axial direction of the electrophotographic photosensitive member (a sectional view taken along line IIIB-IIIB of FIG. 3A). FIG. 3C is a sectional view of the protruding portions of the mold in the circumferential direction of the electrophotographic photosensitive member (sectional view taken along line IIIC-IIIC of FIG. 3A). The mold illustrated in FIGS. 3A to 3C had the protruding portions with a maximum width X (the maximum width of each protruding portion of the mold in the axial direction of the electrophotographic photosensitive member when viewed from above) of 50 μm, a maximum length Y (the maximum length of each protruding portion of the mold in the circumferential direction of the electrophotographic photosensitive member when viewed from above) of 75 μm, an area percentage of 56%, and a height H of 4 μm. The term "area percentage" refers to the percentage of the area of the protruding portions with respect to the area of the entire surface. The temperatures of the electrophotographic photosensitive member and the mold were controlled in such a manner that the temperature of a surface of the electrophotographic photosensitive member was 120° C. during the processing. The electrophotographic photosensitive member was rotated in the circumferential direction while pressing the electrophotographic photosensitive member and a pressure member against the mold at a pressure of 7.0 MPa, thereby forming depressed portions on the entire surface of the surface layer (peripheral surface) of the electrophotographic photosensitive member.

As described above, an electrophotographic photosensitive member of Example 1 was produced.

Calculation of Area Percentage and Particle Area of Metal Oxide in Layer with SEM In an embodiment of the present invention, the area percentage of a portion of the undercoat layer originating from the metal oxide can be determined by observation of an electron image captured using a SEM and subsequent image processing. In a sample in which a resin portion and a metal oxide portion are present as in the undercoat layer according to an embodiment of the present invention, the metal oxide portion appears bright (white, high in brightness), and the resin portion appears dark (black, low in brightness). Thus, a high-contrast image is obtained.

In this example, a scanning electron microscope (SEM) S-4800 (manufactured by Hitachi Ltd.) was used. The area percentage of a portion originating from the metal oxide is calculated from the image processing of an image obtained by mainly visualizing backscattered electrons at an acceleration voltage of 2.0 kV. Only the metal oxide was extracted from the image with the SEM to produce a contrast image containing the resin portion and the metal oxide portion. The area of the portion originating from the metal oxide was determined from this image, and the area percentage of the portion originating from the metal oxide was calculated with respect to the area of the entire image. For 50 metal oxide particles, the area values of the portions originating from the metal oxide were calculated using the resulting projection image. The metal oxide particles used here are not the primary particles of the metal oxide, but indicate masses of the metal oxide particles (secondary particles) formed by aggregation of multiple metal oxide particles. The area values of the portions originating from the metal oxide were determined by using image processing software Image-Pro Plus 5.1J (available from Media Cybernetics, Inc).

An unnecessary portion such as a character string at the bottom of the resulting image was deleted. The image was cut into a size of 1280×895. Using "Intensity Range Selection" in "Count/Size" of Image-Pro Plus 5.1J, the intensity range was set in the range of 140 to 255 to extract a high-brightness portion of the image. The area select ranges were set to a minimum of 10 pixels and a maximum of 10,000 pixels to extract the portion originating from the metal oxide in the undercoat layer. The same operation was repeated until the number of extracted metal oxide particles reached 50. The pixel area of the extracted metal oxide particles was converted to calculate the area originating from the metal oxide particles.

In the SEM observation of the cross section of the undercoat layer of Example 1, the average particle cross-sectional area of the strontium titanate particles dispersed in the cross section of the layer was calculated to be 0.05 $\mu m^2$, and the area percentage of the metal oxide in the undercoat layer was calculated to be 90%.

Example 2

An electrophotographic photosensitive member of Example 2 was produced as in Example 1, except that the strontium titanate particles S-1A used for the undercoat layer coating liquid was changed to particles S-2A. The SEM observation of the cross section of the layer of Example 2 indicated that the average particle cross-sectional area of the strontium titanate particles dispersed in the cross section of the layer was 0.35 $\mu m^2$, and the area percentage of the metal oxide in the undercoat layer was 80%. Table 1 presents the evaluation results of the electrophotographic photosensitive member of Example 2.

Examples 3 to 6

Electrophotographic photosensitive members of Examples 3, 4, 5, and 6 were produced as in Example 1, except that the strontium titanate particles S-1A used for the undercoat layer coating liquid was changed to particles S-1B, S-1C, S-1D, and S-1E, respectively. The SEM observation of the cross sections of the undercoat layers of Examples 3, 4, 5, and 6 indicated that the average particle cross-sectional areas of the strontium titanate particles dispersed in the cross sections of the layers were 0.1 $\mu m^2$, 0.02 $\mu m^2$, 0.16 $\mu m^2$, and 0.38 $\mu m^2$, respectively, and the area percentages of the metal oxide in the undercoat layers were 90%, 85%, 85%, and 70%, respectively. Table 1 presents the evaluation results of the electrophotographic photosensitive members of Examples 3 to 6.

Examples 7 to 25

Electrophotographic photosensitive members of Examples 7 to 25 were produced as in Example 1, except that the guanamine resin (the compound represented by general formula (A)), the charge transport material (the compound represented by general formula (I)), and the amounts thereof used were changed in accordance with Table 1. The same evaluations as in Example 1 were performed. Table 1 presents the results.

Example 26

An electrophotographic photosensitive member of Example 26 was produced as in Example 1, except that the production of the surface layer was changed as described below. The same evaluations as in Example 1 were performed. Table 1 presents the results.

First, 2.6 parts by mass of exemplified compound (1-16), 1.8 parts by mass of exemplified compound (1-8), 0.6 parts by mass of exemplified compound (1-26), and 0.05 parts by mass of the guanamine compound (exemplified compound A-24), serving as charge transport materials, were dissolved in 10 parts by mass of tert-butyl alcohol (BuOH) to prepare a surface layer coating liquid. The resulting surface layer coating liquid was applied to the charge transport layer by dipping and dried at 150° C. for 40 minutes to form a surface layer having a thickness of 5 μm.

Example 27

An electrophotographic photosensitive member of Example 27 was produced as in Example 1, except that the production of the surface layer was changed as described below. The same evaluations as in Example 1 were performed. Table 1 presents the results.

First, 2.6 parts by mass of exemplified compound (I-16), 1.8 parts by mass of exemplified compound (I-8), 0.6 parts by mass of exemplified compound (I-26), serving as charge transport materials, 0.075 parts by mass of exemplified compound (B-8) serving as a melamine compound, and 0.1 parts by mass of 1,3,5-trioxane were dissolved in 10 parts by mass of tert-butyl alcohol (BuOH) to prepare a surface layer coating liquid. The resulting surface layer coating liquid was applied to the charge transport layer by dipping and dried at 150° C. for 40 minutes to form a surface layer having a thickness of 5 μm.

Example 28

An electrophotographic photosensitive member of Example 28 was produced as in Example 1, except that in the drying step in the formation of the surface layer, the drying conditions were changed from 150° C. for 40 minutes to 180° C. for 15 minutes. The same evaluations as in Example 1 were performed. Table 1 presents the results.

Example 29

An electrophotographic photosensitive member of Example 29 was produced as in Example 1, except that the amount of the guanamine compound contained in the surface layer coating liquid and the charge transport material content were changed as described below. The same evaluations as in Example 1 were performed. Table 1 presents the results.

Guanamine compound G-2: 3.3 parts by mass

Charge transport material I-16: 2.7 parts by mass

Comparative Example 1

An electrophotographic photosensitive member of Comparative example 1 was produced as in Example 1, except that the undercoat layer coating liquid was prepared as described below. The same evaluations as in Example 1 were performed. Table 1 presents the results.

Production of Undercoat Layer

First, 100 parts by mass of zinc oxide (average particle size: 70 nm, available from Tayca Corporation, specific surface area: 15 $m^2/g$) was mixed with 500 parts by mass of tetrahydrofuran under stirring. Then 1.3 parts by mass of a silane coupling agent (KBM-503, available from Shin-Etsu Chemical Co., Ltd.) was added thereto. The mixture was stirred for 2 hours. Toluene was removed by distillation under reduced pressure. Baking was performed at 120° C. for 3 hours to provide zinc oxide surface-treated with the silane coupling agent.

Next, 110 parts by mass of the surface-treated zinc oxide was mixed with 500 parts by mass of tetrahydrofuran under stirring. A solution of 0.6 parts by mass of alizarin in 50 parts by mass of tetrahydrofuran was added thereto. The mixture was stirred at 50° C. for 5 hours. The resulting alizarin-containing zinc oxide was separated by filtration under reduced pressure and dried at 60° C. under reduced pressure to give alizarin-containing zinc oxide.

Next, 38 parts by mass of a solution of 60 parts by mass of the alizarin-containing zinc oxide, 13.5 parts by mass of a curing agent (blocked isocyanate, Sumidur 3175, available from Sumika Bayer Urethane Co., Ltd.), and 15 parts by mass of a butyral resin (S-Lec BM-1, available from Sekisui Chemical Co., Ltd.) in 85 parts by mass of methyl ethyl ketone was mixed with 25 parts by mass of methyl ethyl ketone. The mixture was dispersed with a sand mill using glass beads having a diameter of 1 mm for 2 hours to prepare a dispersion. Then 0.005 parts by mass of dioctyltin dilaurate, serving as a catalyst, and 40 parts by mass of silicone resin particles (Tospearl 145, available from GE Toshiba Silicones) were added to the resulting dispersion to provide an undercoat layer coating liquid. The coating liquid was applied to a cylinder by dipping and subjected to drying and curing at 170° C. for 40 minutes, thereby providing an undercoat layer having a thickness of 18 μm. The SEM observation of the cross section of the undercoat layer of Comparative example 1 indicated that the average particle cross-sectional area of the strontium titanate particles dispersed in the cross section of the layer was 0.09 $\mu m^2$, and the area percentage of the metal oxide in the undercoat layer was 85%.

Comparative Example 2

An electrophotographic photosensitive member of Comparative example 2 was produced as in Example 1, except that the undercoat layer coating liquid and the surface layer coating liquid were prepared as described below. The same evaluations as in Example 1 were performed. Table 1 presents the results.

Production of Undercoat Layer

An undercoat layer coating liquid was prepared in the same manner as in Comparative example 1.

Production of Surface Layer

A surface layer coating liquid was prepared in the same manner as in Example 27.

Evaluation of Electrophotographic Photosensitive Member

Evaluation of Potential Change

Two evaluation apparatuses were provided. One of the apparatuses was a copier (trade name: IR-ADV C5560F, available from CANON KABUSHIKI KAISHA). A (primary) charging unit was a rubber roller-type contact charging unit (charging roller) in which an alternating current was superimposed on a direct current. An exposure unit was a laser exposure unit. As a pre-exposure unit, a light-emitting diode (LED) was used. Each of the electrophotographic photosensitive members of Examples 1 to 29 and Comparative examples 1 and 2 was installed in the evaluation apparatus.

The evaluation apparatus was placed in an environment with a temperature of 23° C. and a relative humidity of 50%. In the charging roller, the AC component had a peak-to-peak amplitude of 1,500 Vpp and a frequency of 1,500 Hz, and the DC component had a voltage of −550 V. The initial dark-area potential (Vda) before a repeated-use test was adjusted to −550 V. The initial light-area potential (Vla) before the repeated-use test through exposure by irradiation with 780-nm laser was adjusted to −200 V in each electrophotographic photosensitive member.

The other apparatus was a copier (trade name: IR-ADV C3330F, available from CANON KABUSHIKI KAISHA). A (primary) charging unit was a rubber roller-type contact charging unit (charging roller) to which a direct current was applied. An exposure unit was a laser exposure unit. An LED was used as a pre-exposure unit. Each of the electrophotographic photosensitive members of Examples 1 to 29 and Comparative examples 1 and 2 was installed in the evaluation apparatus.

The evaluation apparatus was placed in an environment with a temperature of 23° C. and a relative humidity of 50%. In the charging roller, the DC component had a voltage of −1,300 V. The initial dark-area potential (Vda) before a repeated-use test was adjusted to −700 V. The initial light-area potential (Vla) before the repeated-use test through exposure by irradiation with 780-nm laser was adjusted to −200 V in each electrophotographic photosensitive member. The initial light-area potential (Vla) before the repeated-use test through exposure by irradiation with 780-nm laser was adjusted to −200 V in each electrophotographic photosensitive member.

The surface potential of each of the electrophotographic photosensitive members was measured by removing a developing cartridge from each evaluation apparatus and inserting a potential measuring instrument. The potential measuring instrument includes a potential measuring probe disposed at the development position of the developing cartridge. The potential measurement probe was provided in the center of the drum-shaped electrophotographic photosensitive member in the axial direction while being 3 mm away from the surface of the electrophotographic photosensitive member.

The evaluation was performed according to a procedure described below. The evaluation was performed while the AC component, the DC component, and the exposure conditions initially set for each electrophotographic photosensitive member remained unchanged. The electrophotographic photosensitive members were evaluated after being allowed to stand for 48 hours in the environment with a temperature of 23° C. and a relative humidity of 50% to allow the electrophotographic photosensitive member to adapt to the environment. Each electrophotographic photosensitive member and the potential measuring instrument were installed in each evaluation apparatus. The initial dark-area potential (Vda) and the initial light-area potential (Vla) were measured. A 9,999-sheet long-term durability test was performed by passing sheets. The dark-area potential (Vdb) at the 10,000th sheet and the light-area potential (Vlb) at the 10,000th sheet were measured. Changes in dark-area potential and light-area potential described below were calculated: a change in dark-area potential ΔVd(ab) [=the initial dark-area potential (Vda)−the dark-area potential (Vdb) at 10,000th sheet] and a change in light-area potential ΔVl(ab) [=the initial light-area potential (Vla)−the light-area potential (Vlb) at 10,000th sheet].

Evaluation criteria are described below:

AA: Both of ΔVd and ΔVl were within ±10 V.

A: Both of ΔVd and ΔVl were within ±15 V.

B: Either ΔVd or ΔVl was more than 15 V.

C: Either ΔVd or ΔVl was more than 20 V.

TABLE 1

Production conditions and evaluation results of photosensitive member

| | Undercoat layer | Surface layer | | | | |
|---|---|---|---|---|---|---|
| | | Guanamine compound/ methylene compound | | Charge transport material | | Evaluation result |
| Example | Type of particles | Type | Amount in camposition (parts by mass) | Type | Amount in composition (parts by mass) | Potential change |
| Example 1 | S-1A | A-14 | 3.00 | I-16 | 3.00 | AA |
| Example 2 | S-2A | A-14 | 3.00 | I-16 | 3.00 | A |

TABLE 1-continued

| Production conditions and evaluation results of photosensitive member | | | | | | |
|---|---|---|---|---|---|---|
| | | Surface layer | | | | |
| | Undercoat | Guanamine compound/ methylene compound | | Charge transport material | | Evaluation |
| Example | layer Type of particles | Type | Amount in camposition (parts by mass) | Type | Amount in composition (parts by mass) | result Potential change |
| Example 3 | S-1B | A-14 | 3.00 | I-16 | 3.00 | AA |
| Example 4 | S-1C | A-14 | 3.00 | I-16 | 3.00 | AA |
| Example 5 | S-1D | A-14 | 3.00 | I-16 | 3.00 | AA |
| Example 6 | S-1E | A-14 | 3.00 | I-16 | 3.00 | A |
| Example 7 | S-1A | A-15 | 3.00 | I-25 | 3.00 | AA |
| Example 8 | S-1A | A-15 | 3.00 | I-20 | 3.00 | AA |
| Example 9 | S-1A | A-15 | 3.00 | I-16 | 3.00 | AA |
| Example 10 | S-1A | A-17 | 3.00 | I-25 | 3.00 | AA |
| Example 11 | S-1A | A-14 | 3.00 | I-20 | 3.00 | AA |
| Example 12 | S-1A | A-14 | 3.00 | I-21 | 3.00 | AA |
| Example 13 | S-1A | A-15 | 3.00 | I-33 | 3.00 | AA |
| Example 14 | S-1A | A-15 | 3.00 | I-10 | 3.00 | AA |
| Example 15 | S-1A | A-15 | 3.00 | I-11 | 3.00 | AA |
| Example 16 | S-1A | A-15 | 3.00 | I-27 | 3.00 | AA |
| Example 17 | S-1A | A-15 | 3.00 | I-30 | 3.00 | AA |
| Example 18 | S-1A | A-17 | 3.00 | I-9 | 3.00 | A |
| Example 19 | S-1A | A-14 | 3.00 | I-23 | 3.00 | A |
| Example 20 | S-1A | A-15 | 3.00 | I-8 | 3.00 | A |
| Example 21 | S-1A | A-17 | 3.00 | I-9 | 3.00 | A |
| Example 22 | S-1A | A-14 | 3.00 | I-4 | 3.00 | A |
| Example 23 | S-1A | A-15 | 3.00 | I-3 | 3.00 | A |
| Example 24 | S-1A | A-15 | 3.00 | I-2 | 3.00 | A |
| Example 25 | S-1A | A-15 | 3.00 | I-5 | 3.00 | A |
| Example 26 | S-1A | A-24 | 0.05 | I-8/I-16/I-26 | 2.6/1.8/0.6 | A |
| Example 27 | S-1A | B-8 | 0.075 | I-8/I-16/I-26 | 2.6/1.8/0.6 | A |
| Example 28 | S-1A | A-14 | 3.00 | I-16 | 3.00 | B |
| Example 29 | S-1A | A-14 | 3.30 | I-16 | 2.70 | B |
| Comparative example 1 | ZnO | A-14 | 3.00 | I-16 | 3.00 | C |
| Comparative example 2 | ZnO | B-8 | 0.08 | I-8/I-16/I-26 | 2.6/1.8/0.6 | C |

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2018-195912 filed Oct. 17, 2018, which is hereby incorporated by reference herein in its entirety.

What is claimed is:

1. An electrophotographic photosensitive member, comprising:

a support;

an undercoat layer;

a photosensitive layer; and a surface layer, the undercoat layer containing a binder resin and strontium titanate particles, the surface layer being a cured film of a composition containing at least one compound selected from the group consisting of a guanamine compound and a melamine compound, and a charge transport material having at least one substituent selected from the group consisting of —OH, —$OCH_3$, —$NH_2$, —SH, and —COOH, wherein in a cross-sectional backscattered electron image of the undercoat layer captured using a scanning electron microscope at an acceleration voltage of 2.0 kV, a region originating from the strontium titanate particles has an area of 0.001 $\mu m^2$ or more and 0.35 $\mu m^2$ or less, and the area of the region originating from the strontium titanate particles is 50% or more and 90% or less of an area of a region originating from the binder resin.

2. The electrophotographic photosensitive member according to claim 1, wherein the guanamine compound is one selected from the group consisting of a compound represented by general formula (A) and its multimer:

(A)

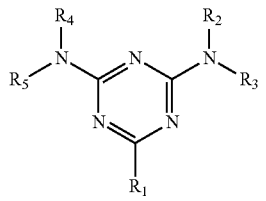

where in general formula (A), $R_1$ is an alkyl group having 1 or more and 10 or less carbon atoms, a phenyl group having 6 or more and 10 or less carbon atoms, or an alicyclic hydrocarbon group having 4 or more and 10 or less, $R_2$ to $R_5$ are each independently a hydrogen atom or —$CH_2$—O—$R_6$, and where $R_6$ is a hydrogen atom or an alkyl group having 1 or more and 10 or less carbon atoms.

3. The electrophotographic photosensitive member according to claim 1, wherein the melamine compound is one selected from the group consisting of a compound represented by general formula (B) and its multimer:

(B)

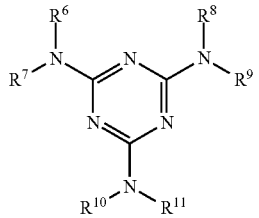

where in general formula (B), $R_6$ to $R_{11}$ are each independently a hydrogen atom, —$CH_2$—OH, —$CH_2$—O—$R_{12}$, or —O—$R_{12}$, where $R_{12}$ is an alkyl group having 1 or more and 5 or less.

4. The electrophotographic photosensitive member according to claim 1, wherein in the composition, an amount of the at least one compound selected from the group consisting of the guanamine compound and the melamine compound is 0.1% or more by mass and 50.0% or less by mass based on an amount of the charge transport material.

5. A process cartridge attachable to and detachable from a main body of an electrophotographic apparatus, comprising:

an electrophotographic photosensitive member; and at least one unit selected from the group consisting of a charging unit, a developing unit, a transfer unit, and a cleaning unit, the process cartridge integrally supporting the electrophotographic photosensitive member and the at least one unit, wherein the electrophotographic photosensitive member comprises:

a support;

an undercoat layer;

a photosensitive layer; and a surface layer, wherein the undercoat layer contains a binder resin and strontium titanate particles, and the surface layer is a cured film of a composition containing at least one compound selected from the group consisting of a guanamine compound and a melamine compound, and a charge transport material having at least one substituent selected from the group consisting of —OH, —$OCH_3$, $NH_2$, —SH, and —COOH, and wherein in a cross-sectional backscattered electron image of the undercoat layer captured using a scanning electron microscope at an acceleration voltage of 2.0 kV, a region originating from the strontium titanate particles has an area of 0.001 $\mu m^2$ or more and 0.35 $\mu m^2$ or less, and the area of the region originating from the strontium titanate particles is 50% or more and 90% or less of an area of a region originating from the binder resin.

6. An electrophotographic apparatus, comprising:

an electrophotographic photosensitive member;

a charging unit;

an exposure unit;

a developing unit; and a transfer unit, wherein the electrophotographic photosensitive member comprises:

a support;

an undercoat layer;

a photosensitive layer; and a surface layer, and wherein the undercoat layer contains a binder resin and strontium titanate particles, and the surface layer is a cured film of a composition containing at least one compound selected from the group consisting of a guanamine compound and a melamine compound, and a charge transport material having at least one substituent selected from the group consisting of —OH, —$OCH_3$, —$NH_2$, SH, and —COOH, and wherein in a cross-sectional backscattered electron image of the undercoat layer captured using a scanning electron microscope at an acceleration voltage of 2.0 kV, a region originating from the strontium titanate particles has an area of 0.001 $\mu m^2$ or more and 0.35 $\mu m^2$ or less, and the area of the region originating from the strontium titanate particles is 50% or more and 90% or less of an area of a region originating from the binder resin.

* * * * *